US009797125B2

(12) United States Patent
Takahashi et al.

(10) Patent No.: US 9,797,125 B2
(45) Date of Patent: Oct. 24, 2017

(54) CONNECTING MEMBER FOR COLUMN AND CONNECTION STRUCTURE OF COLUMN

(71) Applicant: SENQCIA CORPORATION, Tokyo (JP)

(72) Inventors: Hideaki Takahashi, Tokyo (JP); Kumiko Masuda, Matsudo (JP); Hidenori Tanaka, Funabashi (JP)

(73) Assignee: SENQCIA CORPORATION, Tokyo (JP)

( * ) Notice: Subject to any disclaimer, the term of this patent is extended or adjusted under 35 U.S.C. 154(b) by 74 days.

(21) Appl. No.: 14/864,454

(22) Filed: Sep. 24, 2015

(65) Prior Publication Data

US 2016/0090729 A1 Mar. 31, 2016

(30) Foreign Application Priority Data

Sep. 30, 2014 (JP) ..... 2014-200120

(51) Int. Cl.
*E04B 1/24* (2006.01)

(52) U.S. Cl.
CPC ..... *E04B 1/2403* (2013.01); *E04B 2001/246* (2013.01); *E04B 2001/2451* (2013.01); *E04B 2001/2454* (2013.01)

(58) Field of Classification Search
CPC ..... E04B 2001/2415; E04B 2001/2406; E04B 2001/2448; E04B 2001/2457; E04B 2001/246; E04B 2001/2454; E04B 1/2403; E04B 1/2466; E04B 1/1903; E04B 1/1909; F16B 7/00
See application file for complete search history.

(56) References Cited

U.S. PATENT DOCUMENTS

2015/0082719 A1 3/2015 Takahashi et al.

FOREIGN PATENT DOCUMENTS

| | | | |
|---|---|---|---|
| JP | 2012172371 | A | 9/2012 |
| JP | 2012172372 | A | 9/2012 |
| JP | 2012211459 | A | 11/2012 |
| TW | 201435185 | A | 9/2014 |

OTHER PUBLICATIONS

Jul. 15, 2016 Office Action issued in Taiwanese Patent Application No. 104130787.

*Primary Examiner* — Jonathan Masinick
(74) *Attorney, Agent, or Firm* — Oliff PLC

(57) ABSTRACT

A cutout part is formed at the approximate center of the connecting member. The cutout part in the connecting member is a circular penetrating hole that penetrates a convex part and a main body part. On the side of a lower surface of the connecting member, the convex part is formed around the cutout part. The convex part includes a tapered part and a rib. The tapered part gradually inclines in the direction toward the center from the side of the main body part (the side of the base part of the convex part) to the tip side (the side of the top part thereof). The rib part is formed on the edge part of the cutout part, which is the top part of the tapered part. The rib part is a part that protrudes downward from the top part of the tapered part.

5 Claims, 10 Drawing Sheets

CONNECTING MEMBER FOR COLUMN AND CONNECTION STRUCTURE OF COLUMN

TECHNICAL FIELD OF THE INVENTION

This invention relates to a connecting member for columns, which is used at a connecting part of columns in a construction using steel-pipe columns, and a connection structure of columns using the same.

BACKGROUND OF THE INVENTION

Conventionally, in a construction using steel-pipe columns, there are parts that connect columns in the vertical direction. For such connection parts, the sizes of the columns to be connected in the vertical direction may differ. An example is a case in which the size of an upper column is smaller than that of the lower column. In such cases, there is a method in which a taper shaped connecting member is used between columns to be connected.

However, manufacturing such a taper shaped member is difficult. In addition, since the taper shaped member meets obliquely with the upper and lower horizontal surfaces connected thereof, an edge surface of a backing metal, which is a plate-like member provided at the connection part between the taper shaped member and the horizontal surface, is not in surface contact but in line contact with the horizontal surface. Therefore, welding at this part becomes difficult and may cause welding defects.

On the other hand, columns that are to be connected vertically may not always be arranged coaxially. For example, a column is classified either as a center column, a side column, or a corner column according to the position of the column in the construction, and the connection position of the upper and lower columns is different in each of the column structures. And, if the connection positions of columns are different in this way, the strength required for the connecting member for columns differs depending on the connection position of the column. However, thickening the whole body so to be adaptable to every case may result in increase in weight and cost. Therefore, it is necessary to reinforce each part with an appropriate shape.

As such a connection structure of columns, there is a connecting member for columns that has marks showing each of the connection positions for a center column, a side column, and a corner column (Patent Document 1).

RELATED ART

Patent Documents

[Patent Document 1] Japanese Unexamined Patent Application Publication No. 2012-172371 (JP-A-2012-172371)

SUMMARY OF THE INVENTION

Problems to be Solved by the Invention

However, the connecting member for columns in Patent Document 1 has directionality and it is possible that the connecting direction may be mistaken at the construction site.

The present invention was achieved in view of such problems. Its object is to provide a connecting member for columns and a connection structure of columns of which the installing direction may not be mistaken even if the connection positions of columns are different when the sizes of the upper and lower columns are different.

Means for Solving Problems

To achieve the above object, a first invention is a connecting member for columns comprising an approximately rectangular main body part and a convex part provided on the lower surface of the main body part, in which the amount of protrusion of the convex part is increased toward the center. At the center part of the convex part, a cutout part, which is a penetrating or non-penetrating hole, is formed toward the thickness direction of the main body part. The convex part and the cutout part are both formed in line symmetry to both axes of symmetry, in which the axes of symmetry are the center lines of the main body part that are parallel to each sides of the main body part.

Preferably, the convex part comprises a tapered part of which the amount of protrusion increases gradually from the lower surface of the main body part and a rib that is a top part of the tapered part and formed on the edge part of the cutout part.

The cutout part may be a penetrating hole that penetrates the main body part. The cutout part may also be a non-penetrating hole that is formed to a predetermined depth of the main body part and a thin body part may be formed on the side of the upper surface of the main body part.

According to the first invention, the connecting member for columns has no directionality in connecting direction so that it is possible to install the connecting member for columns in any direction. Also, weight reduction can be achieved by having the cutout part, and desired strength can be obtained by the convex part.

Particularly, forming the rib on the edge part of the cutout part secures the strength for the section which is weak in strength at the most.

Also, if the cutout part is a penetrating hole, greater weight reduction can be achieved. If the cutout part is a non-penetrating hole, a thin body part is formed on the upper surface, which can secure the strength.

A second invention is a connection structure for columns using a connecting member for columns wherein the connecting member for columns comprises a main body part and a convex part provided on the lower surface of the main body part in which the amount of protrusion of the convex part is increased toward the center. At the center part of the convex part, a cutout part, which is a penetrating or non-penetrating hole, is formed. The convex part and the cutout part are both formed in line symmetry to both axes of symmetry, in which the axes of symmetry are the center lines of the main body part that are parallel to each side of the main body part. The convex part comprises a tapered part of which the amount of protrusion increases gradually from the lower surface of the main body part and a rib that is a top part of the tapered part and formed on the edge part of the cutout part. A hollow first column is connected to the lower surface of the connecting member for columns. A second hollow column, which is smaller than the first column in size, is connected to the upper surface of the connecting member for columns. The positions of all side faces of the second column are located outside of the inner edge of the rib in planar view.

The second column is eccentric at least to one side of the main body part and the position of the outer side face of the second column on the said side is in the same place with the position of the corresponding outer side face of the first column. In addition, the center position of the thickness of the second column at the part of the side face of the second column that is closest to the cutout part on the side opposite to the eccentric direction of the second column may be positioned within the range of the convex part in planar view.

The center position of the thickness of the second column at the part of the side face of the second column that is closest to the cutout part on the side opposite to the eccentric direction of the second column may be positioned within the range of the rib in planar view.

According to the second invention, the side faces of the second column that is to be connected to the upper surface of the main body part are positioned outside of the rib so that strength can be secured for the connecting member for columns to the second column.

Also, when the second column, which is to be connected to the upper surface of the main body part, is eccentric to the main body part, the strength for the connecting member for columns to the second column can be securely obtained by positioning the center of the side face of the second column on the side opposite to the eccentric direction of the second column within the range of the convex part in planar view.

Particularly, when the center of the side face of the second column on the side opposite to the eccentric direction of the second column is within the range of the rib in planar view, the strength for the connecting member for columns to the second column can be securely obtained even if the second column is more greatly eccentric to the first column.

Effects of the Invention

The present invention can provide a connecting member for columns and a connection structure of columns of which the installing direction may not be mistaken even if the connection positions of columns are different when the sizes of the upper and lower columns are different.

BRIEF DESCRIPTION OF DRAWINGS

FIG. 3 (*b*) is an upper perspective view showing the connecting member 3.

FIG. 4 (*b*) is a bottom view showing the connecting member 3.

FIG. 6 (*b*) shows the connection position of a side column 31 using the connecting member 3.

FIG. 6 (*c*) shows the connection position of a corner column 33 using the connecting member 3.

FIG. 7 (*b*) is an elevated view showing a part of a connection structure of columns in which the column 5*c* is eccentric to the column 5*b*.

DESCRIPTION OF SOME EMBODIMENTS

Figure 1:
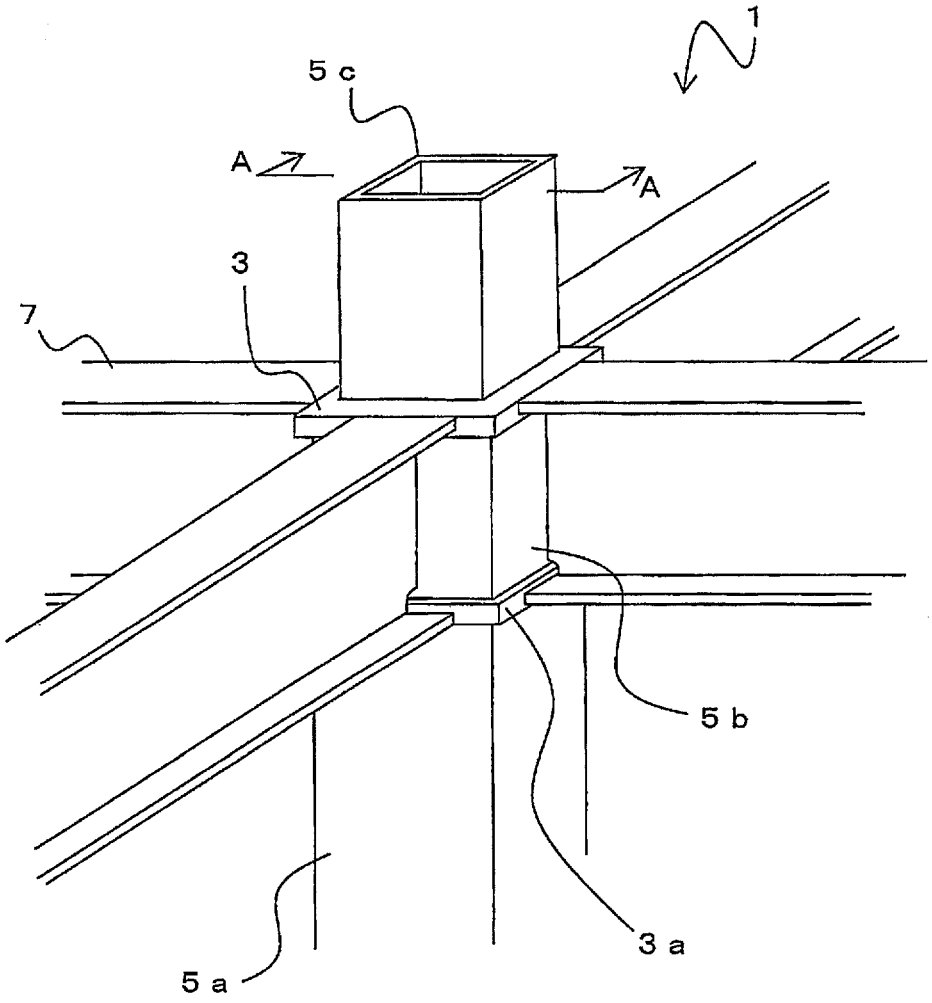
FIG. 1 is a perspective view showing a connection structure of columns 1 using a connecting member 3.
Figure 2:
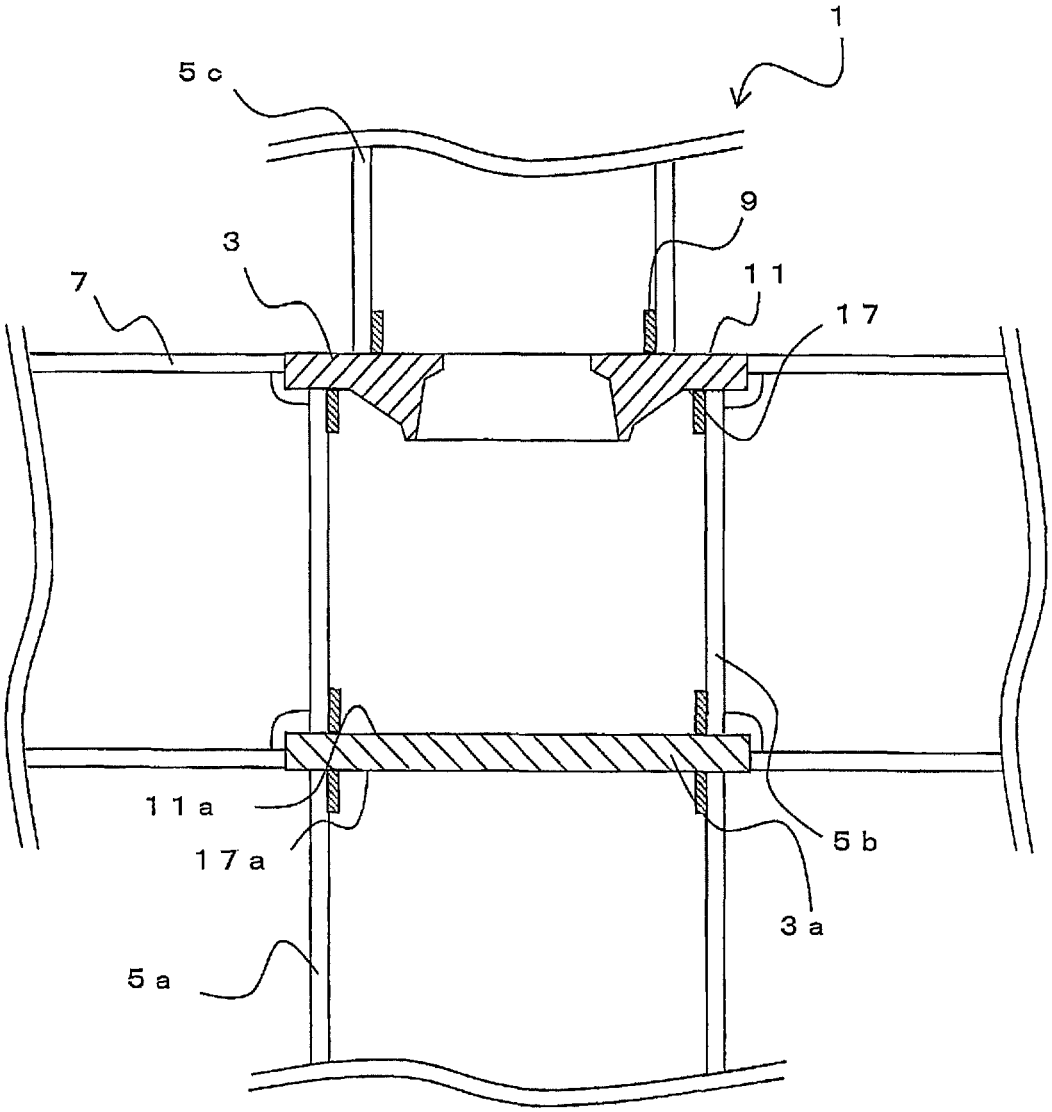
FIG. 2 is an elevated view showing a part of the connection structure of columns 1, which is a cross sectional view of A-A line in FIG. 1.

Hereinafter, a connection structure for columns 1 according to an embodiment of the present invention will be described. FIG. 1 is a perspective view showing a part of the connection structure for columns 1 (a center column) and FIG. 2 is a cross-sectional view of A-A line in FIG. 1. In the connection structure for columns 1, columns 5*a*, 5*b*, and 5*c* are arranged in order from the bottom in the vertical direction and connecting members 3*a* and 3, which are connecting members for columns, are provided in between each of the columns. The upper edge of the column 5*a* is connected to a lower surface 17*a* of the lower connecting member 3*a* and the lower edge of the column 5*b* is connected to an upper surface 11*a* of the lower connecting member 3*a*. Also, the upper edge of the column 5*b* is connected to a lower surface 17 of the connecting member 3. Furthermore, the lower edge of the column 5*c* is connected to an upper surface 11 of the connecting member 3. The connecting member 3*a* may be an ordinary plate-like connecting member. Also, the connecting member 3 may be used for the connection between the columns 5*a* and 5*b* in place of the connecting member 3*a*.

The columns 5*a* and 5*b* are hollow square-shaped steel pipes of the same size. The column 5*c* is a hollow square-shaped steel pipe which is smaller in size than the columns 5*a* and 5*b*. The connecting member 3*a* is a rectangular-shaped plate-like member which is slightly larger in size than the column 5*b*. The connecting member 3*a* is, for example, made of steel and approximately 300 to 1000 mm square, which can be set arbitrarily according to the size of the column to be connected.

A beam 7 is connected horizontally to a region of the column 5*b*, which is in between the connecting member 3 and 3*a*. Therefore, the edge parts of a flange part of the beam 7 are connected to the side faces of the connecting members 3 and 3*a*, and the edge part of a web part of the beam 7 is connected to the side face of the column 5*b*. That is, the distance of installation between the upper and lower connecting members 3 and 3*a* (the length of the column 5*b*) is almost equivalent to the height of the beam 7. The web part of the beam 7 has cutouts provided at the upper and lower edge parts thereof (in the vicinity of the flange part) so to avoid interference with the connecting members 3 and 3*a*. Also, backing metals 9 are disposed on the inner faces of the columns 5*a*, 5*b*, and 5*c* at the connecting parts of the columns 5*a*, 5*b*, and 5*c* with the connecting members 3 and 3*a*.

Figure 3:
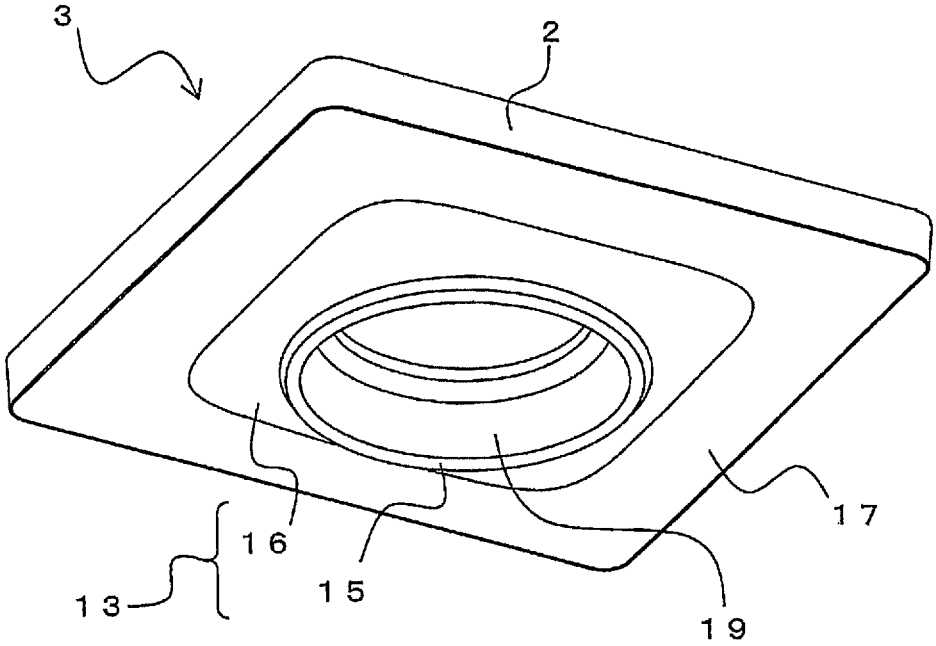
FIG. 3 (*a*) is a bottom perspective view showing the connecting member 3.
Figure 3:
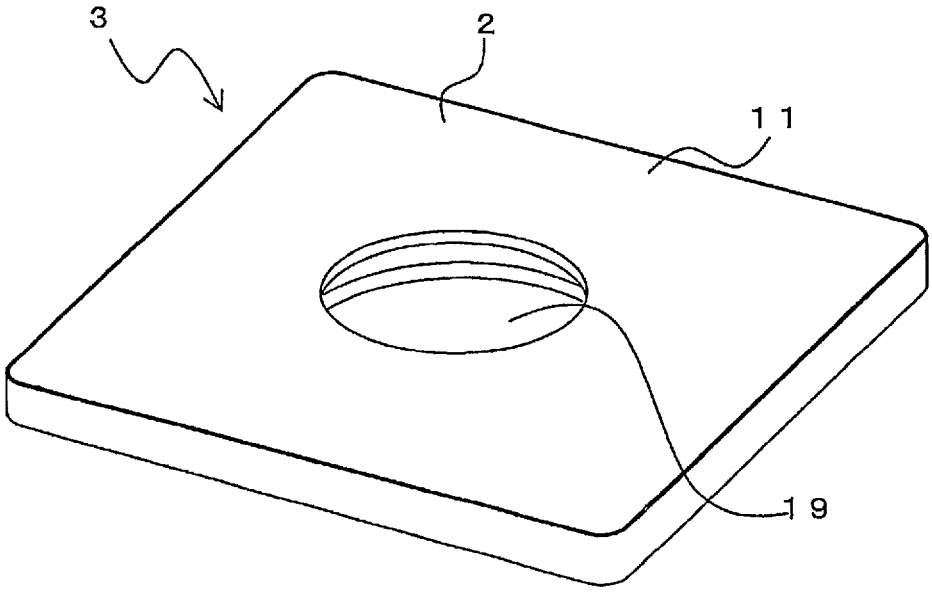

Next, the connecting member 3 will be described in details. FIG. 3 (*a*) is a lower perspective view showing the connecting member 3, FIG. 3 (*b*) is an upper perspective view showing the connecting member 3, FIG. 4 (*a*) is a side view of the connecting member 3, and FIG. 4 (*b*) is a bottom view. The connecting member 3 comprises a main body part 2, which is an approximately rectangular flat plate, and a convex part 13.

A cutout part 19 is formed at the approximate center of the connecting member 3. The cutout part 19 in the connecting member 3 is a circular penetrating hole that penetrates the convex part 13 and the main body part 2. Making the cutout part 19 such a penetration hole increases the effect of weight reduction, and it can be also used as a gas venting hole at the time of plating process and the like. The diameter of the cutout part 19 is small on the side of the upper surface 11 and increases gradually toward the top part of the convex part 13 (on the side of the lower surface). The diameter of the cutout part 19 is decreased at an approximately constant inclination in the range from the top part of the convex part 13 up to the thickness of the main body part 2 and is rapidly decreased in the range of the thickness of the main body part 2.

On the side of the lower surface 17 of the connecting member 3, the convex part 13 is formed around the cutout part 19. The convex part 13 comprises a tapered part 16 and a rib 15. The tapered part 16 gradually inclines in the direction toward the center from the side of the main body part 2 (the side of the base part of the convex part 13) to the tip side (the side of the top part thereof). Also, the side of the main body part 2 (the side of the base of the convex part 13) of the tapered part 16 is approximately rectangular and gradually becomes circular toward the tip side (the side of the top part) of the convex part 13.

The rib 15 is formed at the edge part of the cutout part 19, which is the top part of the tapered part 16. The rib part 15 is a part that protrudes downward from the top part of the tapered part 16. That is, the height of the convex part 13 varies gently with regard to the thickness direction of the connecting member 3 in the tapered part 16 and becomes rapidly high only at the part of the rib 15.

Figure 4:
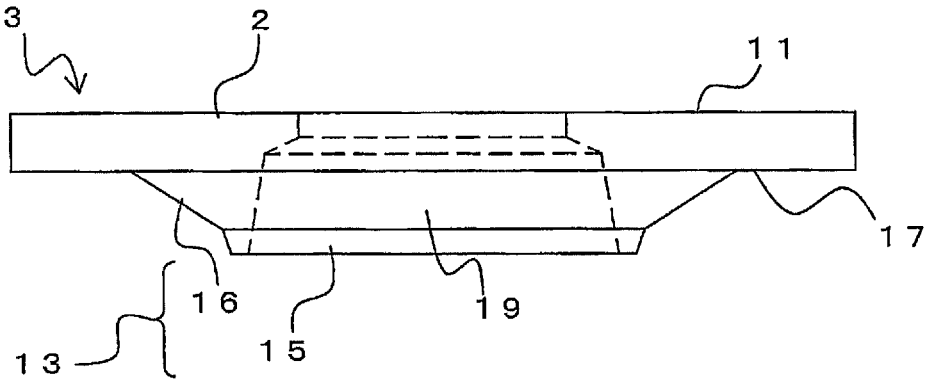
FIG. 4 (*a*) is a side view showing the connecting member 3.
Figure 4:
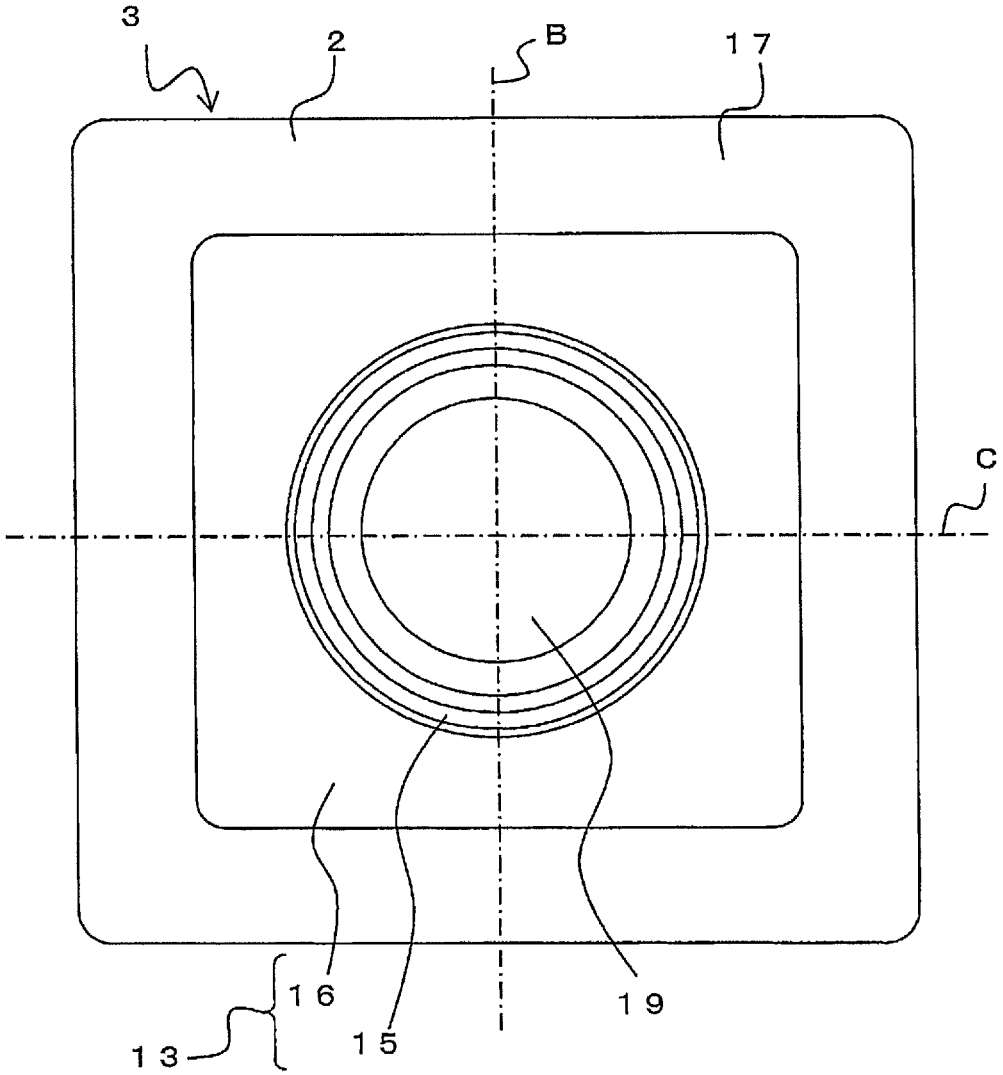

As shown in FIG. 4 (*b*), the convex part 13 and the cutout part 19 are both formed in line symmetry to both axes of symmetry in which the center lines B and C that are parallel to each sides of the main body part 2 are the axes of symmetry respectively. That is, the convex part 13 and the cutout part 19 do not have directionality when viewed from any side of the main body part 2. Therefore, even if the connecting member 3 is disposed in any direction with any side as a base, the convex part 13 and the cutout part 19 always remain in fixed forms.

The periphery of the convex part 13, which is on the lower surface 17 of the connecting member 3, is a flat part. The upper surface 11 of the connecting member 3 is also a flat part except for the cutout part 19. The flat parts of the main body part 2 become the connection parts for the columns 5*b* and 5*c*.

Figure 5:
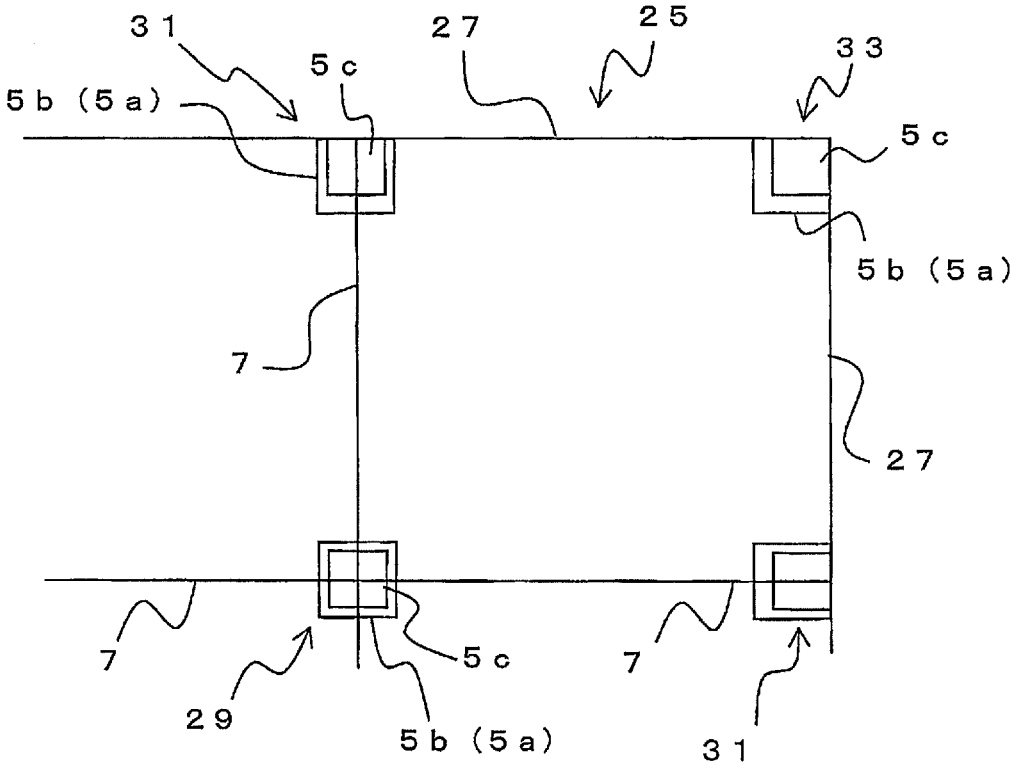
FIG. 5 is a schematic view showing the arrangement of columns in a structure 25.

Next, a structure 25 using the connecting member 3 will be described. FIG. 5 is a plan schematic view showing the structure 25 of which the circumference is surrounded by an external wall 27 and the columns 5*b* (5*a*) are disposed at predetermined intervals. The columns 5*b* (5*a*) are connected to one another with the beams 7. The connecting members 3 and the like are omitted in FIG. 5 for simplification. The columns 5*c* with smaller diameter than the columns 5*b* (5*a*) are disposed on the columns 5*b* (5*a*) that are disposed below.

Here, the part of the columns to which the beams 7 are connected in four directions is called a center column 29. Also, the part of the columns of which one side has the external wall 27 is called a side column 31. Furthermore, the part of the columns that is formed on a corner of the structure 25 and has the external wall 27 formed in two directions is called a corner column 33.

For the center column 29, the beams 7 are connected both lengthwise and crosswise in horizontal directions and the column 5*c* is arranged concentrically with the column 5*b* (5*a*). That is, the center of the column 5*b* (5*a*) below corresponds with the position of the center of the column 5*c* with a smaller outer diameter.

As for the side column 31, the center of the column 5*b* (5*a*) below does not correspond with the position of the center of the column 5*c* with a smaller outer diameter and the column 5*c* is arranged eccentrically in one direction (for example, upward in the drawing) to the column 5*b* (5*a*). The column 5*c* is arranged eccentrically toward the external wall 27 side so that the side face of the column 5*b* (5*a*) on the external wall 27 side is at the same position as the side face of the column 5*c* on the external wall 27 side. That is, the column 5*c* is eccentric in one direction of the column 5*b* (5*a*) but not in the directions vertical to the eccentric direction (for example, to the left or right in the drawing).

On the other hand, the corner column 33 is eccentric in both directions of the external walls 27 that are in contact in two directions thereof. The column 5*c* is arranged eccentrically to each side of the external walls 27 so that each side face of the column 5*b* (5*a*) on the external wall 27 side is at the same position as the corresponding side face of the column 5*c* on the external wall 27 side. That is, the column 5*c* is eccentric in one direction of the column 5*b* (5*a*) (for example, the external wall 27 side on the upper side in the drawing) as well as is eccentric for the same amount in the direction vertical thereto (for example, to the external wall 27 side on the right in the drawing).

Figure 6:
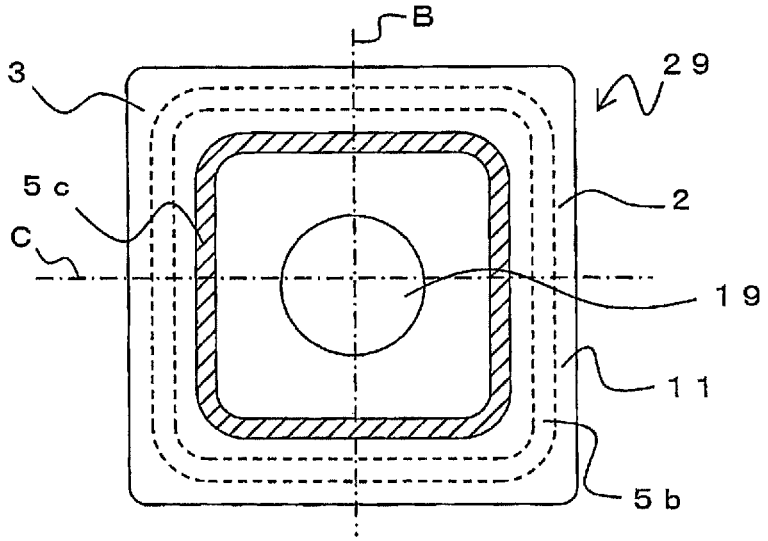
FIG. 6 (*a*) shows the connection position of a center column 29 using the connecting member 3.
Figure 6:
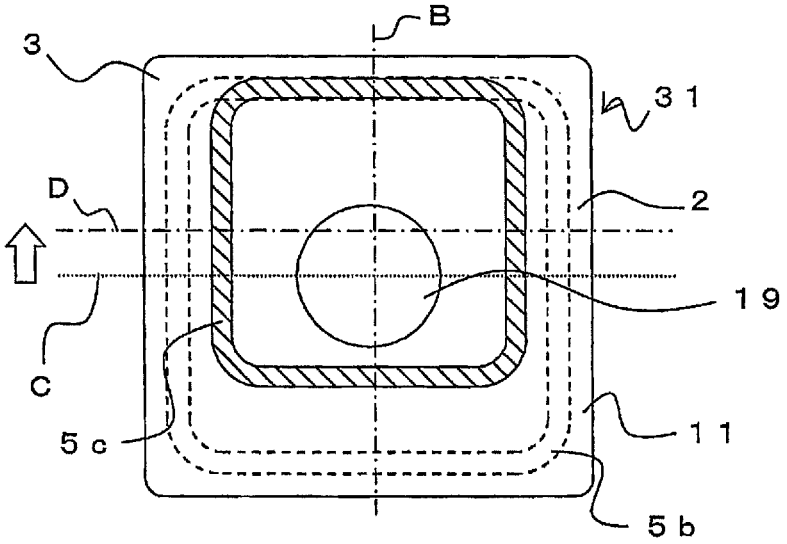
Figure 6:
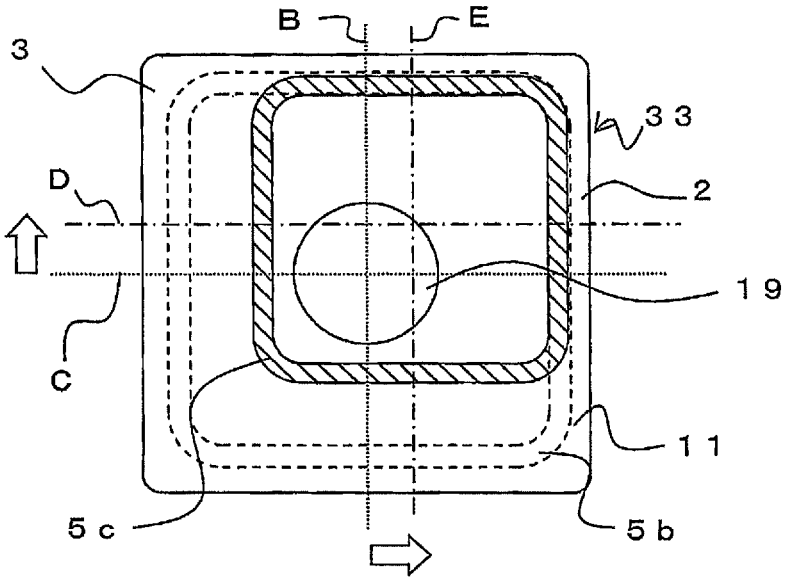

FIG. 6 (*a*) to FIG. 6 (*c*) are plan cross sectional views showing the arrangements of the column 5*c* (the second column) with regard to the column 5*b* (the first column) in each of the column positions. FIG. 6 (*a*) shows the center column 29, FIG. 6 (*b*) shows the side column 31, and FIG. 6 (*c*) shows the corner column 33 respectively.

As shown in FIG. 6 (*a*), in the center column 29, the connecting member 3 is disposed on the column 5*b* and the column 5*c* is disposed at the center of the upper surface 11 of the connecting member 3. Therefore, the center lines B and C of the connecting member 3 correspond to the center lines of the column 5*c*. Here, the column 5*b* and 5*c* are both connected to the flat parts of the main body part 2. Also, the center of the column 5*b* that is disposed below the connecting member 3 always corresponds with the center of the connecting member 3 in any of the arrangements.

On the other hand, as shown in FIG. 6 (*b*), in the side column 31, the column 5*b* below and the column 5*c* above are disposed with the connecting member 3 in between so that a side face of the column 5*b* (upper side in the drawing) is in the same place with a side face of the column 5*c* (upper side in the drawing). Therefore, the center line C of the connecting member 3 is eccentric to the center line D of the column 5*c*. However, the center line B of the connecting member 3 corresponds with the center line of the column 5*c* in the direction vertical to the side where the two side faces are in the same place (left and right directions in the drawing). In this case, column 5*b* and 5*c* are still both connected to the flat parts of the main body part 2.

Usually, the difference between the outer diameters of columns having different diameters, which are disposed above and below the connecting member 3, is approximately between 50 mm and 150 mm. Therefore, the amount of eccentricity is approximately between 25 mm and 75 mm.

Similarly, as shown in FIG. 6 (*c*), in the corner column 33, the column 5*b* below and the column 5*c* above are arranged with the connecting member 3 in between so that a side face of the column 5*b* (upper side in the drawing) corresponds with a side face of the column 5*c* (upper side in the drawing), and, furthermore, for the direction vertical thereto, another side face of the column 5*b* (right side in the drawing) corresponds with another side face of the column 5*c* (right side in the drawing). Therefore, the center line C of the connecting member 3 and the center line D of the column 5*c* are eccentric to each other and, also, the center line B of the connecting member 3, which intersects with the center line C, and the center line E of the column 5*c* are eccentric to each other.

As mentioned above, since the difference between the outer diameters of columns with different diameters, which are disposed above and below the connecting member 3, is usually between 50 mm and 150 mm approximately, the amount of eccentricity is approximately between 25 mm and 75 mm respectively. Also, the amount of eccentricity is substantially equivalent in each of the directions.

Figure 7:
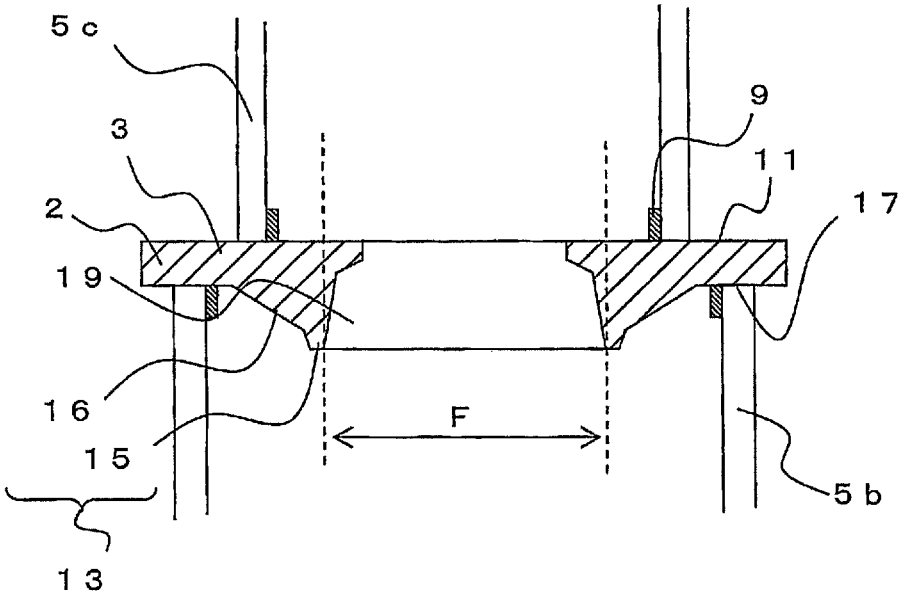
FIG. 7 (*a*) is an elevated view showing a part of a connection structure of columns in which the centers of a column 5*c* and a column 5*b* meet.
Figure 7:
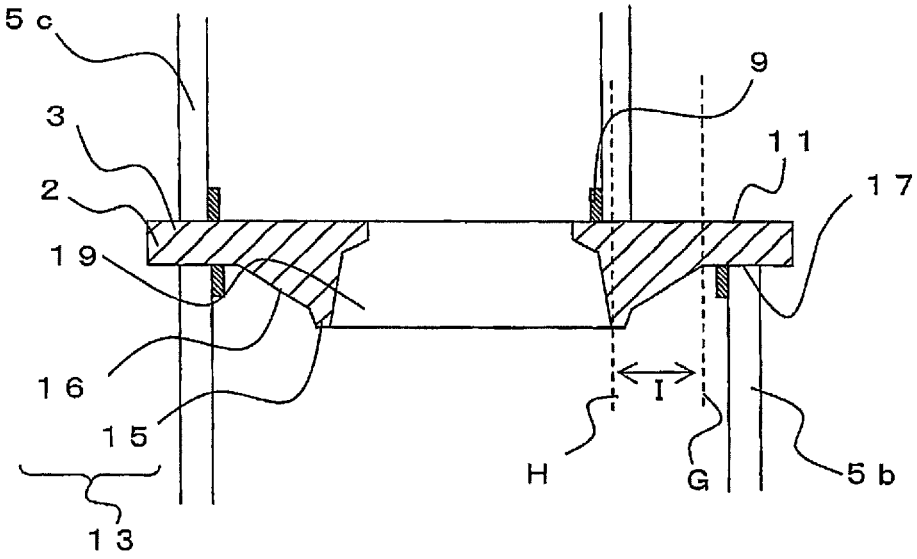

Next, the connection position of the column 5*c* and the connecting member 3 will be described in detail. FIG. 7 (*a*) is a cross sectional view of a case in which the center of the column 5*c* corresponds with the center of the connecting member 3, which, for example, is a cross section of the center lines B and C in FIG. 6 (*a*) or a cross section of the center line C in FIG. 6 (*b*). As mentioned above, the column 5*b* is connected to the flat part outside the convex part 13 on the side of the lower surface 17 of the connecting member 3. Also, the column 5*c* is connected to the flat part outside the cutout part 19 on the side of the upper surface 11 of the connecting part 3.

Here, the column 5*c* is disposed outside of the inner edge part of the rib 15 (the cutout part 19). That is, the center positions of the thickness of the column 5*c* are never positioned inside the inner edge of the rib 15 (F in the drawing) even at the part where the side face of the column 5*c* is closest to the cutout part 19 (i.e. the position of cross section of the center line of the main body part 2). Also, in the case of the center column, it is preferable that all the center positions of the thickness of the column 5*c* are within the forming range of the convex part 13.

Also, FIG. 7 (*b*) is a cross sectional view of a case in which the column 5*c* is eccentric from the center of the connecting part 3 and is, for example, a cross sectional view of the center line B in FIG. 6 (*b*) or a cross sectional view of the center lines B and C in FIG. 6 (*c*). As mentioned above, also in this case, the column 5*b* is connected to the flat part outside the convex part 13 on the side of the lower surface 17 of the connecting member 3. Also, the column 5*c* is connected to the flat part outside the cutout part 19 on the side of the upper surface 11 of the connecting member 3.

In the example shown in FIG. 7 (*b*), the column 5*c* is eccentric at least to one side of the main body part 2, and the position of the outer side face on the said side (the side face on the left side in the drawing) is in the same place with the position of the corresponding outer side face of the column 5*b*. Also, the center position of the thickness of the column 5*c* at the part of the side face of the column 5*c* that is closest to the cutout part 19 (i.e. the cross section of the center line of the main body part 2) on the side opposite to the eccentric direction of the column 5*c* (on the right in the drawing) is positioned within the range of the convex part 13. Here, "within the range of the convex part 13" is the range between the base part of the tapered part 16 and the inner edge of the rib 15.

Particularly, when the size of the column 5*c* is smaller than that of the column 5*b*, the center position of the thickness of the column 5*c* at the part of the side face of the column 5*c* that is closest to the cutout part 19 (i.e. the cross section of the center line of the main body part 2) on the side opposite to the eccentric direction of the column 5*c* (on the right in the drawing) is preferably positioned within the range of the rib 15.

Here, when the column 5*c* is connected to the connecting member 3, the strength required for the connecting member 3 becomes less as the connecting position with the column 5*c* is closer to the side of the outer circumference of the main body part 2 (the side closer to the side face of the column 5*b*). Therefore, the height of the convex part 13 can be reduced toward the outer circumference. However, when the column 5*c* is connected to the connecting member 3, the strength required for the connecting member 3 becomes larger as the connecting position with the column 5*c* is shifted toward the center of the main body part 2. Therefore, it is necessary to increase the height of the convex part 13 increasing the thickness toward the center.

Also, when the column 5*c* is connected to the connecting member 3 and if the connecting position with the column 5*c* is positioned in the vicinity of the top part of the convex part 13, which is a boundary part with the cutout part 19, the connecting member 3 requires particularly large strength. Therefore, the rib 15 is provided at the top part of the convex part 13 to increase the thickness of the connecting member 3, making it possible to securely obtain the strength. Also, since large stress is not given to the vicinity of the center part of the main body part 2 to which the column 5*c* is never connected, it is possible to provide a cutout part 19 to achieve weight reduction.

With the connecting member 3 in accordance with the present embodiment, it is possible to apply a connecting member in the most suitable shape for the columns 5*c* in each of the positions of the center column 29, side column 31, and corner column 33. Therefore it is possible to obtain required strength without being excessively heavy. Also, since the connecting member 3 does not have directionality in the connecting direction, mistakes in choosing the connecting direction does not occur.

Also, the height of the convex part 13 is set according to the position of the side face of the column 5*c*. Therefore, required strength can be securely obtained by the convex part 13 even if the column 5*c* is connected eccentrically to the connecting member 3. Particularly, since the rib 15 is formed in the vicinity of the boundary part with the cutout part 19 where the conditions of strength are most severe, it is possible to securely obtain the required strength even if the connection position of the column 5 is close to the center of the main body part 2.

Also, since the connection position of the column 5*c* can be changed to anywhere within the range of the convex part 13, the same connecting member 3 can be applied for the columns 5*c* with different sizes.

The shape of the column is not limited to the square shaped column with approximately square shape shown as examples in embodiments, and the present invention can be applicable to any types of columns, such as columns with approximately rectangular or circular cross section. Also, the shape of the convex part 13 and the cutout part 19 are not limited to the examples shown in the drawings.

Figure 8:
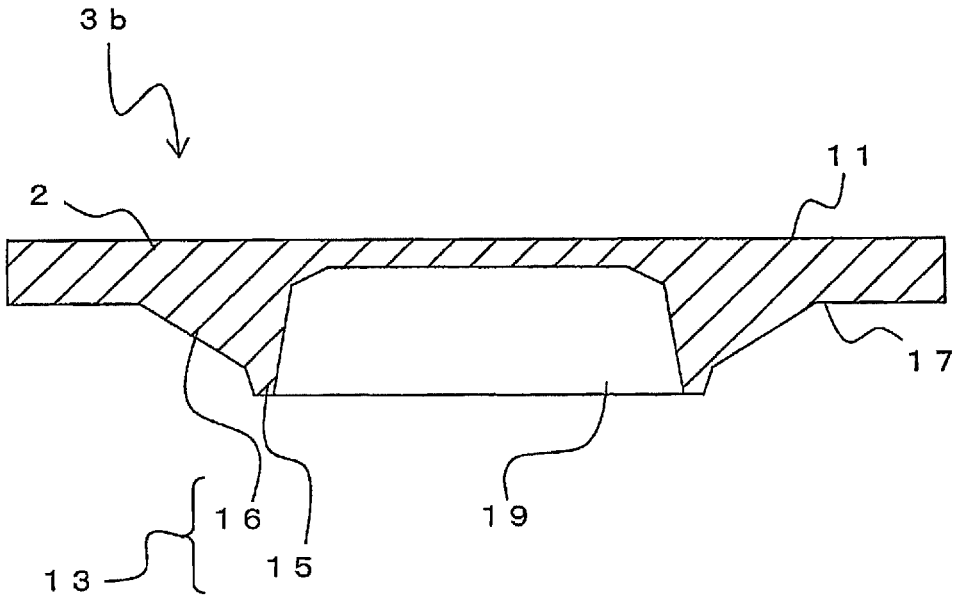
FIG. 8 is a cross sectional view of a connecting member 3*b*.

Also, the cutout part 19 may not be a penetrating hole. For example, as a connecting member 3*b* shown FIG. 8, the cutout part 19 may be a non-penetrating hole formed from the side of the top part of the convex part 13 to the predetermined depth of the main body part 2. In this case, a thin body part is formed on the side of the upper surface of the main body part 2. Further greater strength can be securely obtained by leaving such a thin body part.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

DESCRIPTION OF NOTATIONS

1 . . . connection structure of columns
2 . . . main body part
3, 3*a*, 3*b* . . . connecting member
5*a*, 5*b*, 5*c* . . . column
7 . . . beam
9 . . . backing metal
11, 11*a* . . . upper surface
13 . . . convex part
15 . . . rib
16 . . . tapered part
17, 17*a* . . . lower surface
19 . . . cutout part
25 . . . structure
27 . . . external wall
29 . . . center column
31 . . . side column
33 . . . corner column

What is claimed is:

1. A connecting member for columns comprising:

a main body part being an approximately rectangular plate with an upper surface and a lower surface;

a convex part; and a cutout part, which is a through hole penetrating the main body part, formed toward a direction from the lower surface to the upper surface of the main body part at a center part of the lower surface of the main body part, the convex part being provided around the cutout part on the lower surface of the main body part, and an amount of protrusion of the convex part being increased from a side of a base part of the convex part toward the cutout part, wherein:

the convex part and the cutout part are formed in line symmetry to two axes of symmetry, in which the two axes of symmetry are two perpendicular center lines passing through a center of the main body part, each of the two center lines being respectively parallel to each of two sides of the main body part.

2. The connecting member for columns according to claim 1, wherein the convex part comprises:

a tapered part of which an amount of protrusion increases gradually from the lower surface of the main body part; and a rib that is a top part of the tapered part and formed around the cutout part.

3. A connection structure for columns comprising:

a connecting member for columns, the connecting member including:

a main body part being an approximately rectangular plate with an upper surface, a lower surface, and a convex part; and a cutout part, which is a through hole penetrating the main body part, formed toward a direction from the lower surface to the upper surface of the main body part at a center part of the lower surface of the main body part, the convex part provided around the cutout part on the lower surface of the main body part, and an amount of protrusion of the convex part being increased from a side of a base part of the convex part toward the cutout part, the convex part including: (i) a tapered part of which an amount of protrusion increases gradually from the lower surface of the main body part, and (ii) a rib that is a top part of the tapered part and formed around the cutout part, wherein:

the convex part and the cutout part are formed in line symmetry to two axes of symmetry, in which the two axes of symmetry are two perpendicular center lines passing through a center of the main body part, each of the two center lines being respectively parallel to each of two sides of the main body part;

a hollow first column connected to the lower surface of the connecting member; and a hollow second column, which is smaller in size than the hollow first column, connected to the upper surface of the connecting member, wherein all outer side faces of the hollow second column are located outside of an inner edge of the rib in a planar view.

4. The connection structure for columns according to claim 3, wherein:

the hollow second column is eccentric at least to one side of the main body part;

a position of an outer side face of the hollow second column on one side of the main body part is, in planar view, located in the same location as a corresponding outer side face of the hollow first column; and a center position of a thickness of a side of the hollow second column closest to the cutout part, which is on a side opposite to the outer side face of the hollow second column that is located in the same location as the corresponding outer side face of the hollow first column, is positioned, in planar view, within a range of the lower surface of the main body part where the convex part is provided.

5. The connection structure for columns according to claim 4, wherein a center position of a thickness of a side of the hollow second column closest to the cutout part, which is on a side opposite to the outer side face of the hollow second column that is located in the same location as the corresponding outer side face of the hollow first column, is positioned, in planar view, within a range of the lower surface of the main body part where the rib of the convex part is provided.

* * * * *